United States Patent [19]

Daywalt

[11] Patent Number: 5,048,499

[45] Date of Patent: Sep. 17, 1991

[54] FUEL TREATMENT DEVICE

[76] Inventor: Clark L. Daywalt, 6703 E. 27th St., Tulsa, Okla. 74129

[21] Appl. No.: 502,265

[22] Filed: Mar. 29, 1990

[51] Int. Cl.[5] ..... F02M 27/00

[52] U.S. Cl. ..... 123/538; 123/1 A

[58] Field of Search ..... 123/1 A, 3, DIG. 12, 123/536, 537, 538

[56] References Cited

U.S. PATENT DOCUMENTS

| | | | |
|---|---|---|---|
| 4,050,426 | 9/1977 | Sanderson | 123/538 |
| 4,429,665 | 2/1984 | Brown | 123/1 A |
| 4,611,615 | 9/1986 | Petrovic | 128/538 X |
| 4,715,325 | 12/1987 | Walker | 123/1 A |
| 4,930,483 | 6/1990 | Jones | 123/538 |

*Primary Examiner*—Tony M. Argenbright

*Attorney, Agent, or Firm*—Fleit, Jacobson, Cohn, Price, Holman & Stern

[57] ABSTRACT

A fuel treatment device is an elongated element having an outer surface and a central axis extending between first and second ends in the direction of elongation. The element is made of an alloy containing the following metals: copper, zinc, nickel, lead and tin. A central bore exists within the element and extends along the central axis from an inlet opening at the first end of the element to within a short distance of the second end of the element. A plurality of axial bores communicate between the outer surface of the element and the central bore. Each said axial bore has a cross-sectional area that is at least approximately an order of magnitude smaller than the cross-sectional area of the central bore, and all axial bores together have a cross-sectional area that is at least twice as large as the cross-sectional area of the central bore.

22 Claims, 3 Drawing Sheets

FUEL TREATMENT DEVICE

BACKGROUND OF THE INVENTION

1. Field of the Invention

The present invention pertains to devices for treatment of fuels to enhance combustion. More particularly, the present invention pertains to a metal alloy fuel treatment element and a configuration for that element for use in a fuel flow path.

2. Description of the Prior Art

It is known from a number of prior art sources that metal alloys can be formed into treatment elements that can improve the characteristics of liquids that flow in contact with these elements. U.S. Pat. Nos. 3,486,999 and 3,974,071 show alloy elements that are employed to inhibit corrosion and/or scale deposits in the conduits of water systems. U.S. Pat. No. 3,486,999 teaches use of a self-sacrificing anodic element formed from a crystalline metallic alloy, preferably having copper, zinc and silicon as its primary elements, with lesser amounts of tin, lead, iron and nickel. U.S. Pat. No. 3,974,071 teaches use of alloys that are primarily copper, nickel, lead, zinc and tin, with small or trace amounts of iron, aluminum, phosphorus and chromium, and that are apparently consumed in use.

U.S. Pat. Nos. 4,429,665 and 4,715,325 show alloy elements that are employed to treat liquid fuels for improved combustion. U.S. Pat. No. 4,429,665 teaches use of a metal bar made of an alloy of nickel, zinc, copper, tin and silver. U.S. Pat. No. 4,715,325 teaches use of a non-conductive, non-sacrificing alloy of copper, zinc, nickel, lead and tin.

U.S. Pat. No. 3,440,034 shows a fluid stabilizing alloy element believed to be effective to prevent precipitation of solids in the flow tubes of both oil and water wells. In this alloy, copper, zinc, nickel, lead and tin are present, with lesser amounts of iron, antimony, sulfur and manganese.

The above prior art references do not offer definite explanations of the phenomena leading to the desirable results achieved. In U.S. Pat. Nos. 3,486,999 and 3,448,034, a polarizing effect on the liquid flowing past the treatment element is mentioned. It is theorized that this eliminates any affinity between the mineral substances dissolved in the fluid treated and the flow tubes and other surfaces contacted by the fluid, thus preventing precipitation of minerals in solid form onto such surfaces. In U.S. Pat. No. 4,429,665 it is theorized that the fuel flowing past the treatment element is charged and the repulsion of charged particles increases the rate of fuel vaporization. An alternate theory offered is that application of an electrostatic charge redistributes the molecular pattern of the impurities.

Despite the absence of a firm theory of operation, a variety of benefits have been noted with the pre-existing fuel treatment elements. U.S. Pat. No. 3,448,034 claims reduced accumulation of paraffin and other corrosive substances in oil flow tubes. U.S. Pat. No. 4,429,665 claims greater fuel efficiency and cleaner exhaust emissions as a byproduct. U.S. Pat. No. 4,715,325 adds to those claims increased performance and cleaner fuel flow apparatus downstream of the alloy treatment element.

In addition to focusing on the chemical composition of the metal alloys used to treat fuel or other liquids, the prior art patents mentioned above have also taken note of the fact that turbulent flow around the surface of the fuel treatment alloy aids the desired effects. Accordingly, U.S. Pat. No. 3,486,999 speaks of turbulence above Renolds #2100 and shows fuel treatment elements placed within elongated housings that have special surface configurations or bores to increase velocity of flow and promote turbulence. U.S. Pat. No. 4,429,665 utilizes a casing containing a metal bar with spaced apart ridges transverse to the main direction of flow to promote turbulence in the fuel and insure greater contact between the fuel treatment element and the fuel. U.S. Pat. No. 4,715,325 shows a housing containing fuel treatment elements with longitudinal fins and/or with central passageways to more intimately bring the fuel and alloy into contact with one another. In one embodiment, the fuel treatment element is not a single elongated core but a plurality of balls contained within a housing.

While increased turbulence and passages that cause greater flow velocity are apparently desirable to enhance the operation of fuel treatment elements, in most applications it is necessary to avoid unduly restricting fuel flow, either because the peak fuel needs may not be met or because the frictional losses involved with flow restriction may unduly increase the energy needed to pump fuel through the system. Accordingly, what is needed as an improvement over the prior art is a fuel treatment device that offers adequate alloy surface for fuel contact and a configuration that causes turbulence without "choking off" the flow needed for the fuel system.

SUMMARY OF THE INVENTION

A fuel treatment device in accordance with the present invention is an elongated element having an outer surface and a central axis extending between first and second ends in the direction of elongation. The element is made of an alloy containing the following metals: copper, zinc, nickel, lead and tin. A central bore exists within the element and extends along the central axis from an inlet opening at the first end of the element to within a short distance of the second end of the element. A plurality of axial bores communicate between the outer surface of the element and the central bore. Each said axial bore has a cross-sectional area that is at least approximately an order of magnitude smaller than the cross-sectional area of the central bore, and all axial bores together have a cross-sectional area that is at least twice as large as the cross-sectional area of the central bore.

One object of the invention is to provide a fuel treatment device and fuel treatment method for a fuel flow line to an internal combustion engine or other combustion device that increases combustion efficiency.

Another object of the invention is to provide a fuel treatment device with a fuel flow path that enhances the surface interaction between the alloy from which the device is made and the fuel flowing past it.

A further object of the invention is to provide a method and apparatus for increasing combustion efficiency in an internal combustion engine by treating the fuel flow to the engine with a metallic alloy device to thereby improve fuel effciency and performance and decrease exhaust emissions.

These and other objects of the invention will become more apparent in the following detailed description of the invention, including the accompanying drawings.

FIG. *2a* is an end view of a single fuel treatment element in accordance with the present invention.

FIG. *2b* is a cross-sectional view of a fuel treatment element in accordance with the present invention taken along line *2b–2b* in FIG. *2a*.

FIG. *3a* is an end view of an alternate embodiment of the fuel treatment element of the present invention.

FIG. *3b* is a cross-sectional view of a fuel treament element in accordance with the present invention taken along line *3b–3b* in FIG. *3a*.

FIG. *3c* is an end view of the fuel treatment element of FIG. *3a*, viewed from the opposite end.

Figure 4:
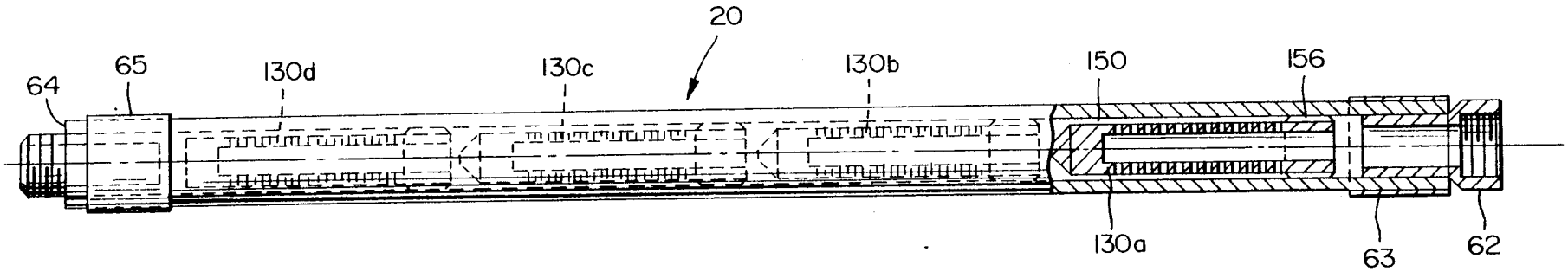

FIG. 4 is a partial cross-sectional view of a fuel treatment assembly containing multiple fuel treatment elements in accordance with the present invention.

DESCRIPTION OF THE PREFERRED EMBODIMENTS

Figure 1:
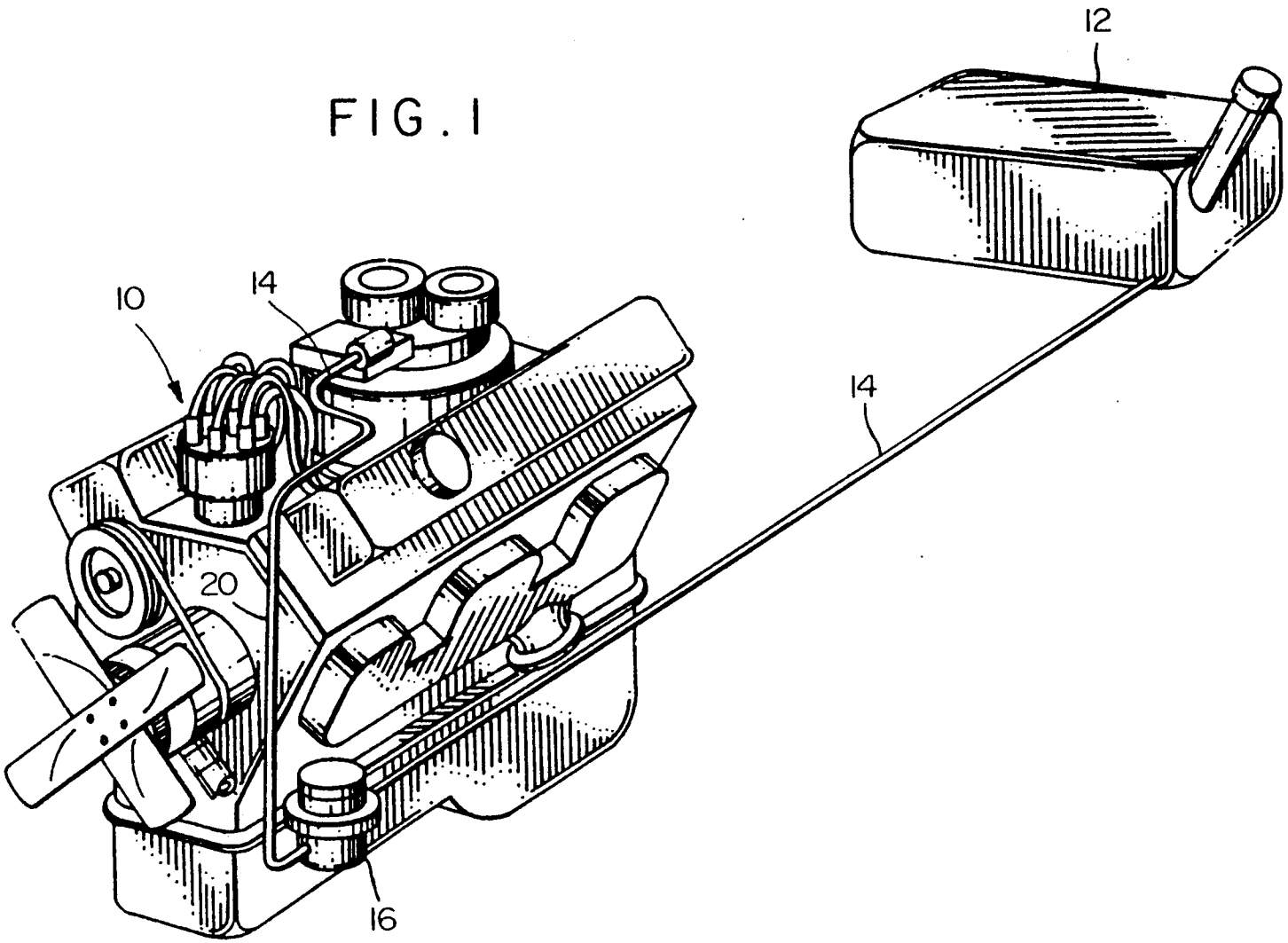
FIG. 1 is a perspective view of an internal combustion engine with its fuel supply and a fuel line connecting the engine and fuel supply, with an assembly utilizing the present invention inserted in the fuel flow line.

While the present invention is applicable to a variety of situations in which it is desired to increase the combustion efficiency of hydrocarbon fuels or to decrease the buildup of precipitated deposits from such fuels, a primary expected field of application is in internal combustion engine fuel delivery systems. FIG. 1 shows an engine 10 such as is used in a conventional vehicle. Fuel is delivered to the engine 10 by a fuel pump 16 from a fuel tank 12 via a fuel line 14. A fuel treatment device 20 made in accordance with the present invention is inserted in the fuel line 14 between the fuel pump 16 and the engine 10 so that the flow of fuel to the engine 10 is exposed to one or more fuel treatment elements contained within the fuel treatment device 20. The structure of an individual fuel treatment element will be explained next.

FIGS. *2a* and *2b* show, respectively, an end and a cross-sectional view of an individual fuel treatment element 30 in accordance with the present invention. The element 30 is elongated and generally cylindrical in shape, with a central axis 32 extending along its length. The outer surface 50 has a set of longitudinal ribs 52 that extend from a first or inlet end 40 to a second, closed end 42. Within the element 30 there is a central bore 34 that extends from the inlet end 40 to within a short distance of the second end 42. As can be seen, the use of a central bore 34 greatly increases the surface area for contacting fuel, better utilizing the volume occupied by the element 30.

To produce a combination of turbulent and laminar flow that seems to aid fulfillment of the objectives of the invention, a set of axial bores or passage 54 communicates between the central bore 34 and the exterior surface 50. The axial bores 54 are aligned in rows in the valleys between the ribs 52. In addition, the axial bores 54 are also aligned in circumferential rings.

In the preferred embodiment shown in FIGS. *2a* and *2b*, the element 30 has six ribs 52 with six corresponding valleys. There are fifteen axial bores 54 aligned in each valley, yielding a total of ninety axial bores. Also significant for the axial bores 54 is their total cross-sectional area. While it is believed that it is important to the interaction of fuel and alloy that the fuel be forced into intimate contact with the alloy material from which the element 30 is made, too much flow restriction within the element 30 may will cause the engine to "starve" during peak fuel demands. Accordingly, the configuration for the fuel treatment element 30 of the present invention represents a careful balancing of forcing intimate contact between fuel and alloy and avoiding undue flow restriction. As will be seen below, when one or more fuel treatment elements is installed in a fuel treatment assembly 20, the elements are contained within a narrow, elongated housing that forces the majority of the fuel flowing in the fuel line to enter the opening at the inlet end 40 and flow into the central bore 34. The fuel that enters the central bore 34 can only exit through the axial bores 54. While it is desirable to avoid undue flow restriction, it is also desirable to set up turbulence in the fuel. The size and orientation of the axial bores 54 together with the closed end 42 are important in causing turbulence. Fuel flowing parallel to the central axis 32 must make a ninety-degree turn to escape through an axial bore 54. In addition, each axial bore 54 has a relatively small cross-sectional area (measured perpendicular to the central axis of the bore) preferably approximately at least án order of magnitude less than the cross-sectional area of the inlet end 40. This small cross-section of the axial bores 54 forces the fuel into intimate contact with the surface of the element 30, if this has not already occurred as the fuel flows into the central bore 34. To counteract the flow restriction in individual axial bores 54, the size and number of axial bores 54 is selected such that the total cross-sectional area of the axial bores 54 is at least twice the cross-sectional area of the element 30 at the inlet end 40 (measured perpendicular to the central axis 32).

As noted above, the fuel element 30 is configured in a narrow housing such that the majority of the fuel enters the central bore 34 and must exit via the axial bores 54. Fuel that does not enter the central bore 34 flows in a relatively smooth path along the ribs 52 of the outer surface 50. But this smooth flow, which occurs primarily in the valleys between ribs 52, is interrupted by the fuel exiting from the axial bores 54. Turbulence is induced by the collision of the relatively smoothly flowing fuel proceeding along the outer surface 50 in a direction parallel to the central axis 32 and the fuel exiting axially outward from the axial bores 54. The fuel that was forced to make a ninety degree turn to exit from the central bore 34 now must make another ninety degree turn to resume flow in the axial direction.

FIGS. *3a*, *3b* and *3c* show a fuel treatment element 130 that is an alternate embodiment of the present invention. It differs from the element 30 shown in FIGS. *2a* and *2b* in three major respects. First, it has a larger outer diameter and its central bore 134 has a larger inner diameter; its axial bores 154 are also larger than the axial bores 54 in FIGS. *2a*, *2b*. Second, it has fins 156 extending outwardly from the ribs 152 for a short distance along the outer surface 150 near the inlet end 140. These fins 156 are used to help establish a firm friction fit of the element within a housing 60, such as is explained next. Third, the second end 142 tapers to form a flange 146, instead of there being a blunt end as in FIG. *2b*. The larger size of the element 130 of FIGS. *3a–3c* gives it greater surface area and therefore greater fuel treatment capacity. The element 130 has essentially the same cross-sectioned area ratios as described for the element 130 of FIGS. *2a–2b*.

Figure 2A:
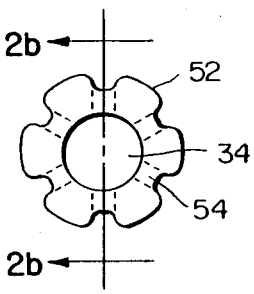
Figure 3A:
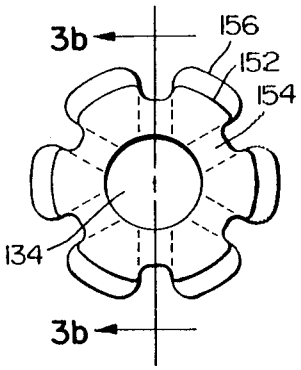
Figure 2B:
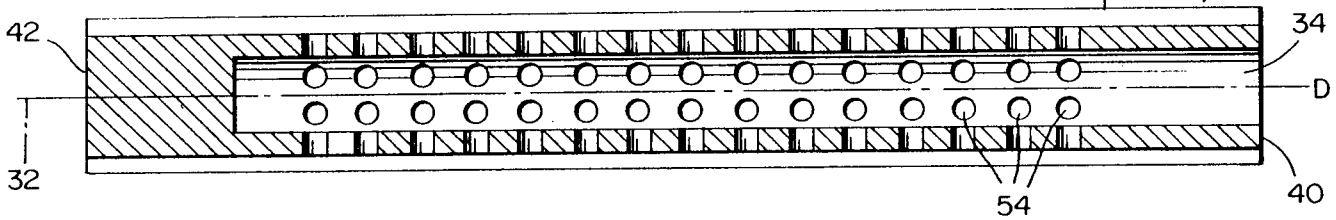
Figure 3B:
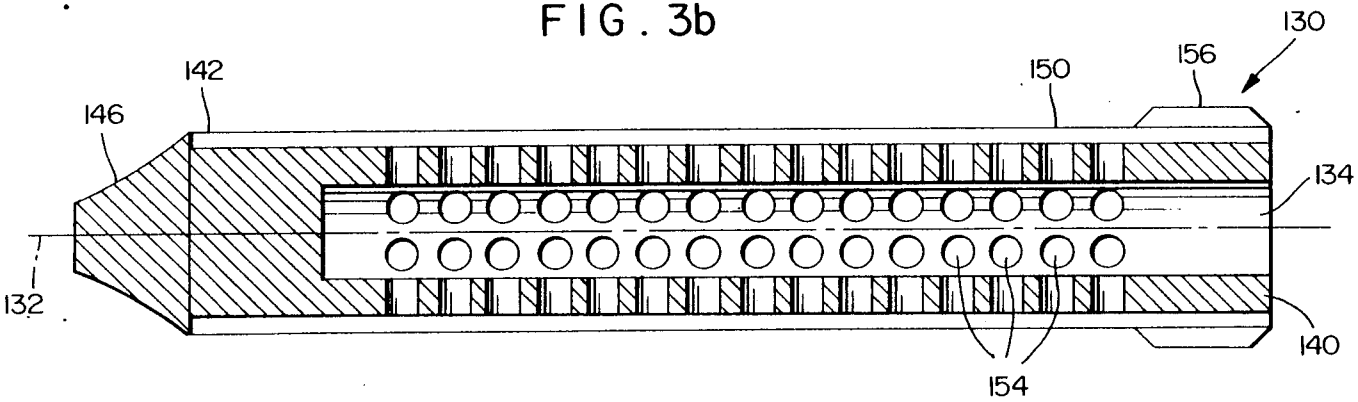
Figure 3C:
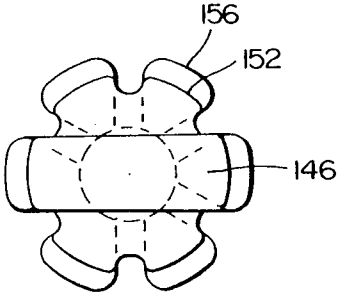

FIG. 4 shows a fuel treatment element assembly 20 that incorporates one or more of the individual fuel treatment elements 30, 130 as shown in FIGS. 2*a*, 2*b*, 3*a*, 3*b* and 3*c* above. The housing 60 may be almost any form of conduit having an inner diameter slightly larger than the outer diameter of the elements it contains, but is preferably a length of flexible, reinforced hose. The inner diameter of the hose is chosen to provide a snug friction fit with the fins 156, when the embodiment 130 as shown in FIGS. 3*a*–3*c* is used. When the embodiment 30 as shown in FIGS. 2*a*–2*b* is used, the housing 60 should also fit relatively closely around the outer surface 50 of the element 30. The exact fit is aided by a suitable bushing (not shown) that fits tightly around the inlet end 40 of the element 30 and can be crimped into the valleys between the ribs 52 and also fits snugly against the interior surface of the housing 60.

As seen in FIG. 4, when multiple elements 130*a*–130*d* are placed within the housing 60, they are positioned in series with their inlet ends facing the flow coming from the fuel tank 12. This helps to insure that fuel that passes along the outer surface 150 of one element 130*a* and encounters lesser turbulence will still have a chance to enter the central bore 134 of one of the other elements 130*b*–130*d* and take a path with greater turbulence. An inlet nipple 62 secured by a retainer band 63 on the outside of the inflow end of the housing 60 provides a connection for fuel from fuel tank 16. An outlet nipple 64 secured by a retainer band 65 at the outflow end of the housing 60 provides a connection to the fuel line 14 leading to the engine 10. To help avoid occlusion of the inlet end 140 of any element 130*a*–130*d*, each element 130*a*–130*d* has a broad point or flange 146 (as shown in FIGS. 3*a* and 3*c*) that extends from the closed end 142. Thus, should the closed end 142 of any element 130*a*–130*d* butt up against the inlet end 140 of any adjacent element, the flange 146 will ensure that most of the inlet end 40 remains unobstructed and available for entry of fuel.

It is desirable for the majority of the fuel flowing into an element 130 placed within a housing 60 to enter the central bore 134 so that it will be forced through the axial bores 154. To encourage this, the diameter of the central bore 134 is preferably at least approximately one-half of the outer diameter of the element 130. The central bore is preferably made as large as possible, given the ribbed structure of an element 130. Obviously, the amount of alloy material remaining in the valleys between the ribs 152 must be sufficient to maintain the structural integrity of the element 130. Another factor in determining how much fuel flow enters the central bore 134 is the internal diameter of the housing 60 relative to the outer diameter of the element 130. As best seen in FIG. 4, the fit between the element 130 and the interior of the housing 60 is relatively snug, with spacing around the outer surface 150 of the element 130 being determined primarily by the diameter of the element 130 at the fins 156 relative to the diameter of the element 130 at the ribs 152 and the depth of valleys between the ribs 152. Preferably, the somewhat annular, cross-sectional area available for flow between the outer surface 150 of an element 130 and the inner surface of the housing 60 does not exceed the smallest cross-sectioned area of the central bore 134 of an element 130.

The composition of the alloy used in the present invention is known in the prior art and is the same as the one shown in U.S. Pat. No. 4,715,325. As disclosed in that patent, the alloy is comprised of copper, zinc, nickel, lead and tin, which can be varied within the following ranges:

| | Percent by weight |
|---|---|
| copper | 40–60% |
| zinc | 2–28% |
| nickel | 5–25% |
| lead | 2–12% |
| tin | 1–5% |

As further disclosed in U.S. Pat. No. 4,715,325, the preferred composition of the alloy is:

| | Percent by weight |
|---|---|
| copper | 57.64% |
| zinc | 17.63 |
| nickel | 13.45 |
| lead | 7.66 |
| tin | 2.69 |
| iron | .69 |
| antimony | .12 |
| sulfur | .07 |
| manganese | .05 |

U.S. Pat. No. 4,715,325 states that the alloy does not provide the desired results when any one of the above components copper, zinc, nickel, lead and tin is deleted from the crystalline metal. It also states that the presence of a trace of iron, antimony, sulfur and manganese appear to be an inherent part of the process used in manufacturing the alloy and that these trace elements are believed not to be important but are included because they result from the alloying process. The above alloy can be purchased commercially from Prattville Casting Company, Inc., located in Sand Springs, Okla. It is formed into the general elongated, ribbed shape shown in FIGS. 2*a*–2*b* and 3*a*–3*c* by a conventional sand casting, investment casting or other similar casting process. The central bore 34 or 134 and the axial bores 54 or 154 are preferably formed by drilling.

In use a fuel treatment device in accordance with the present invention is installed in a fuel line for a vehicle using an internal combustion engine run on either gaseous fuel or diesel fuel. It has been observed that there is an initial increase in emissions from the engine. After about 300 miles both fuel economy as measured in gallons per mile and emissions in the form of HC and CO are measurably improved. This improved state appears to continue indefinitely, as there appears to be no or no significant consumption of the alloy.

EXAMPLE 1

A fuel treatment element in accordance with the present invention was constructed of the alloy described above. The length of the element was 4.0 inches. The diameter as measured at the outermost extent of the ribs was 0.5 inches. The internal diameter of the central bore was 0.25 inches and its depth was 3.5 inches. The internal diameter of each of the axial bores was 0.078 inches. The axial bores were configured in six longitudinal rows, with each row having fifteen axial bores. This yielded an outer surface having an area of about 7.2 square inches before the axial bores were made. The surface area of the central bore was approximately 2.75 inches before the axial bores were made. Each axial bore removed approximately 0.0048 square inches from each of the outer surface area and the surface area of the central bore, but added approximately 0.015 square inches of surface area in the form of a passage between the central bore and the outer surface. This yields a net gain in surface area of approximately 0.52 square inches. Thus, the total active surface area of an element of this size is somewhat in excess of 11.0 square inches. An element of this size has been found effective to increase combustion efficiency in a vehicle that has average fuel economy of 20 miles per gallon of fuel, which corresponds to a fuel flow of about three gallons per hour at highway speeds.

The element as described above was inserted in a copper tube housing and spliced into the fuel line of a 1986 Ford Tempo with a 2.3 liter, 4 cylinder engine. Emissions measured in accordance with State of California standard procedures for vehicle emissions certification before installation of the fuel treatment element were: HC, 14 ppm, and CO 0.03 percent. After installing the element and driving about 1200 miles, emissions measured in the same manner were HC, 7 ppm, and CO, 0.01 percent.

EXAMPLE 2

For larger vehicles, such as vehicles with V8 engines, a larger fuel treatment element with length of 4.0 inches, outermost diameter of 0.75 inches and a central bore 0.375 inches diameter to a depth of 3.5 inches, providing greater surface area, has been found suitable. Axial bores as in Example 1 but with an internal diameter of 0.109 inches were used. This yields an element with about 17.7 square inches of surface area, which has been found sufficient to treat fuel flow of up to about 4 gallons per hour.

Two fuel treatment elements with the preceding dimensions were inserted in a reinforced rubber tube housing and spliced into the fuel line of a 1986 GMC pickup truck with an eight cylinder engine. The total surface area of about 35 square inches afforded by the two elements was suitable to handle the fuel flow of about 7 to 8 gallons per hour. Emissions measured in accordance with State of California standard procedures for vehicle emissions certification before installation of the fuel treatment element were: HC, 101 ppm, and CO, 0.02 percent. After installing the element and driving about 235 miles, emissions measured in the same manner were HC, 11 ppm, and CO, 0.01 percent.

For vehicles with still larger engines, such as over-the-road tractor haulers, consuming fuel at the rate of one gallon for each four to five miles, greater alloy surface area is needed. This is in part caused by the fact that much of the fuel moved by the fuel pump is diverted to a valley in the engine block for cooling purposes. To address this application, three or four elements of the larger size just mentioned are inserted in series in a housing (as shown in FIG. 4) of rubber with high tensile steel braid over at least one layer of polyester braid. In this application, the relatively short four-inch length of the elements is useful, because it permits the housing with the elements inserted to flex for installation and during vibration that may be very heavy when the vehicle is in use.

In sum, it can be seen that the present invention teaches how a fuel treatment element can be configured from metal alloy and used in fuel flow lines to improve combustion. While application in internal combustion engines is contemplated and has been found to improve engine performance, increase per gallon mileage, decrease HC and CO emissions and to clean surfaces that contact fuel, other applications are possible. For example, use in oil fueled heaters or in storage or delivery systems for fuels is also possible.

It will be seen that certain modifications can be made to the invention while maintaining its effectiveness. For example, the configuration of the outer surface of an element or of its central bore could be changed somewhat. Placement of axial bores and relative cross-sectional area of axial bores individually and in total relative to the cross-sectional area of the central bore could also be varied somewhat while preserving the features of causing turbulence and forcing contact with the alloy without unduly restricting flow. Accordingly, the scope of the invention is to be governed by the appended claims rather than the above disclosure.

What is claimed as new and desired to be protected by Letters Patent is:

1. A fuel treatment device comprising:

an elongated element having an outer surface and a central axis extending between first and second ends in the direction of elongation, said element being made of an alloy containing the following metals: copper, zinc, nickel, lead and tin;

a central bore within said element and extending along the central axis from an inlet opening at the first end of said element to within a short distance of the second end of said element; and a plurality of passages each extending through said element between the outer surface of the element and the central bore and providing flow communication between the central bore and said outer surface, each said passage having a cross-sectional area that is at least approximately an order of magnitude smaller than the cross-sectional area of the central bore and all the passages together having a cross-sectional area that is at least twice as large as the cross-sectional area of the central bore.

2. The fuel treatment device as recited in claim 1 wherein the elongated element is generally cylindrical in shape.

3. The fuel treatment device as recited in claim 2 wherein the central bore within the elongated element is generally cylindrical in shape.

4. The fuel treatment device as recited in claim 1 wherein the outer surface of the fuel element has longitudinal ribs extending substantially from the first end to the second end.

5. The fuel treatment device as recited in claim 4 wherein the passages are located in rows extending along valleys between the longitudinal ribs.

6. The fuel treatment device as recited in claim 5 wherein the device has six longitudinal ribs with six valleys between them and there is a row of the passage located in each valley.

7. The fuel treatment device as recited in claim 6 wherein the passages are located in aligned circumferential rings.

8. The fuel treatment device as recited in claim 1 wherein the diameter of the central bore is at least approximately one-half the diameter of the element at its outer suface.

9. The fuel treatment device as recited in claim 1, wherein the central bore terminates at said short distance of the second end of said element.

10. A fuel treatment device comprising:

an elongated hollow enclosure having a first, inflow, and a second outflow end;

at least one fuel treatment element contained within said enclosure in sequential, substantially axial alignment, each said fuel treatment element comprising:

an elongated element having an outer surface and a central axis extending between first and second ends in the direction of elongation, said element being made of an alloy containing the following metals: copper, zinc, nickel, lead and tin;

a central bore within said element and extending along the central axis from an inlet opening at the first end of said element to within a short distance of the second end of said element; and a plurality of passages each extending through said element between the outer surface of the element and the central bore and providing flow communication between the central bore and the outer surface, each said passage having a cross-sectional area that is at least approximately an order of magnitude smaller than the cross-sectional area of the central bore and all the passages together having a cross-sectional area that is at least twice as large as the cross-sectional area of the central bore, each said element being oriented within said enclosure with its inlet end open in the direction of the inflow end of the enclosure.

11. The fuel treatment device as recited in claim 10 wherein each elongated element is generally cylindrical in shape.

12. The fuel treatment device as recited in claim 11 wherein the central bore within each elongated element is generally cylindrical in shape.

13. The fuel treatment device as recited in claim 10 wherein the outer surface of each fuel element has longitudinal ribs extending substantially from the first end to the second end.

14. The fuel treatment device as recited in claim 13 wherein the passages are located in rows extending along valleys between the longitudinal ribs.

15. The fuel treatment device as recited in claim 14 wherein the device has six longitudinal ribs with six valleys between them and there is a row of the passages located in each valley.

16. The fuel treatment device as recited in claim 15 wherein the passages are located in aligned circumferential rings.

17. The fuel treatment device as recited in claim 10 wherein the diameter of the central bore of each element is at least approximately one-half the diameter of that element at its outer surface.

18. The fuel treatment device as recited in claim 10 wherein the cross-sectioned area available for flow between the enclosure and each element does not exceed the smallest cross-sectional area of the central bore of that element.

19. A method for treating fuel treatment to improve combustion comprising:

providing an elongated hollow enclosure having a first, inflow, and a second, outflow, end;

providing within said enclosure at least one fuel treatment element in sequential, axial alignment, each said fuel treatment element comprising:

an elongated element having an outer surface and a central axis extending between first and second ends in the direction of elongation, said element being made of an alloy containing the following metals: copper, zinc, nickel, lead and tin;

a central bore within said element and extending along the central axis from an inlet opening at the first end of said element to within a short distance of the second end of said element; and a plurality of passages each extending through said element between the outer surface of the element and the central bore and providing flow communication between the central and the outer surface, each said passage having a cross-sectional area that is at least approximately an order of magnitude smaller than the cross-sectional area of the central bore and all the passages together having a cross-sectional area that is at least twice as large as the cross-sectional area of the central bore orienting each said element within said enclosure with its inlet end open in the direction of the inflow end of the enclosure; and introducing fuel to be treated at the inflow end and removing treated fuel from the outflow end.

20. The method as recited in claim 19 wherein the step of providing an enclosure comprises providing an enclosure that snugly surrounds each enclosed fuel treatment element such that a majority of the fuel introduced flows into the central core rather than along the outer surface of the fuel treatment element.

21. The method as recited in claim 19 wherein the fuel introduced is diesel fuel.

22. The method as recited in claim 19 wherein the fuel introduced is gasoline.

* * * * *